US009931002B2

(12) United States Patent
Morgan

(10) Patent No.: US 9,931,002 B2
(45) Date of Patent: Apr. 3, 2018

(54) CLEANING CLOTH WITH SOAP

(71) Applicant: Michael Morgan, Houston, TX (US)

(72) Inventor: Michael Morgan, Houston, TX (US)

( * ) Notice: Subject to any disclaimer, the term of this patent is extended or adjusted under 35 U.S.C. 154(b) by 0 days.

(21) Appl. No.: 14/504,732

(22) Filed: Oct. 2, 2014

(65) Prior Publication Data

US 2016/0095476 A1 Apr. 7, 2016

(51) Int. Cl.
*A47K 7/03* (2006.01)

(52) U.S. Cl.
CPC ..... *A47K 7/03* (2013.01)

(58) Field of Classification Search
CPC ..... A47K 7/03
USPC ..... 15/209.1; 401/201; D6/608; D28/63
See application file for complete search history.

(56) References Cited

U.S. PATENT DOCUMENTS 2,006,708 A 7/1935 Benedict
2,339,000 A * 1/1944 Clanton ..... A47K 7/03 401/266
2,574,854 A * 11/1951 West ..... A47K 7/03 15/209.1
2,669,727 A 2/1954 Evans
5,326,610 A * 7/1994 Moss ..... A47K 7/03 15/208
5,545,456 A * 8/1996 Suida ..... A47K 7/022 15/208
2008/0205962 A1* 8/2008 Doby Wilson ..... A47K 7/022 401/6
2010/0077560 A1* 4/2010 Cabullo ..... A63B 47/04 15/209.1
2013/0098381 A1* 4/2013 McBrayer ..... A47K 7/022 15/210.1

* cited by examiner

*Primary Examiner* — Jennifer C Chiang
*Assistant Examiner* — Bradley Oliver
(74) *Attorney, Agent, or Firm* — Delphine James

(57) ABSTRACT

A soap holding cleaning cloth with soap holding pockets located thereon. The cleaning cloth further comprises a top layer overlying a bottom layer of absorbent fabric with a compartment formed there between. The compartment segmented into adjacent pockets for holding various soap elements. Each pocket has an opening that allows the user to place a bar of soap into the cloth. The opening of each pocket has a fastener to close the pocket, so that the soap bar remains inside the cloth.

15 Claims, 8 Drawing Sheets

CLEANING CLOTH WITH SOAP

BACKGROUND OF THE INVENTION

The present invention relates to soap holding cleansing cloths or pads in which soap is held in a manner to be controllably released.

In the past, it has been common to provide wide variety of cleansing pads and sponges that hold soap or cleansing material inside the cleansing pad or sponge. Thus, when the person washes with the sponge or pad, the soap is released. This allows a sponge or cleaning pad to be used without applying the soap separately for cleaning. Most of these devices have the soap dispensed through a sponge or pad. The present invention utilizes a cleansing cloth with tubing in combination with a pocket in the center to dispense soap providing a more efficient manner to distribute soap to the cleaning cloth.

SUMMARY OF THE INVENTION

One of the objectives of the present invention is to provide an apparatus that allows the rapid and efficient distribution of soap into an absorbent cleaning cloth. A soap holding cleaning cloth apparatus is provided which has adjacent pockets for containing a bar of soap and liquid soap. Each pocket has a triangular corner opening secured during by fasteners to hold the soap therein. In other embodiments the solid soap or the liquid soap can be placed within mesh container prior to insertion into the pocket.

The above and other objects, features and advantages of the present invention should become even more readily apparent to those skilled in the art upon a read in of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

DETAILED DESCRIPTION

Figure 1:
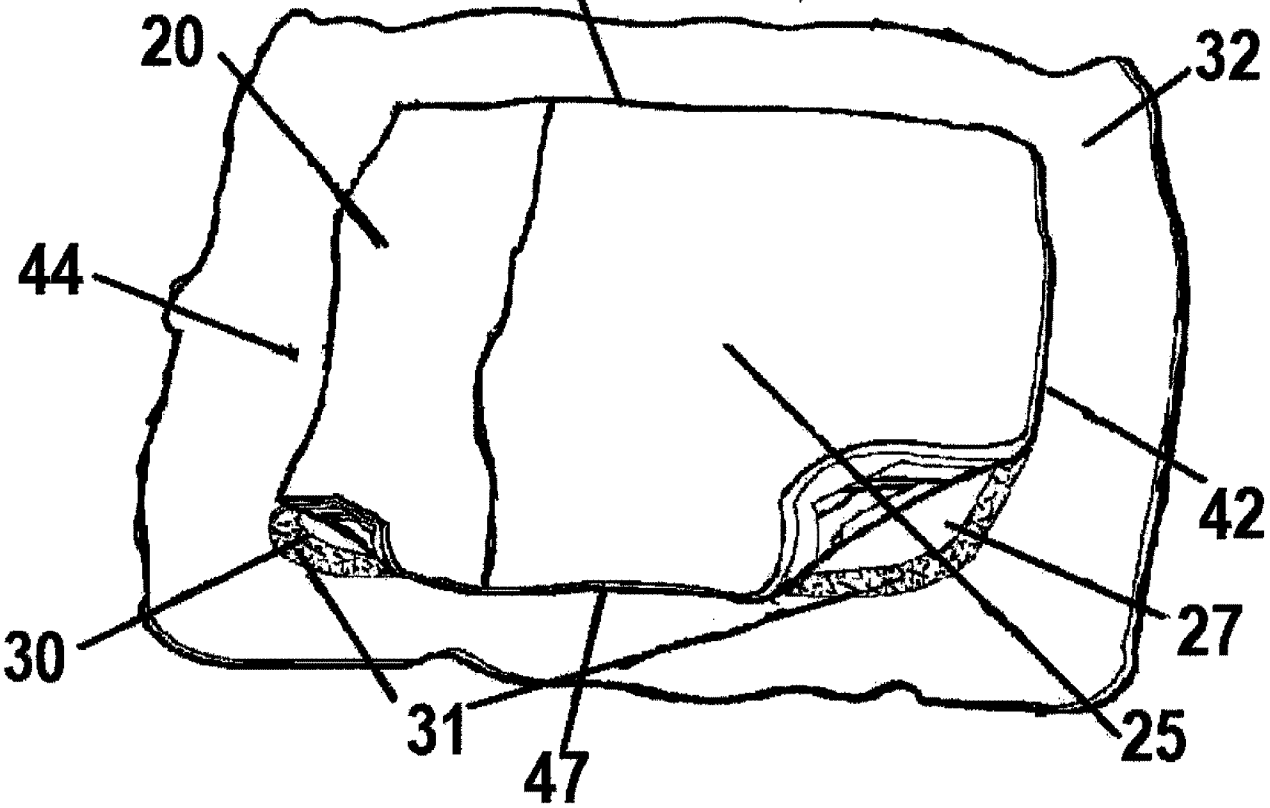
FIG. 1 depicts a perspective view of the cleaning cloth in accordance with the present invention.

Referring to the FIG. 1, there is shown a perspective view of the invention, a multi-layered cleaning cloth (10) with multiple pockets for containing soap is disclosed. The cloth (10) is made of an absorbent material having a bottom layer fabric (32) overlying a top layer fabric (25). The absorbent material can be from a natural woven fiber or synthetic fiber. In one embodiment the absorbent material can be terry cloth made of 100% natural fiber cotton. Alternatively, the absorbent material can be made of cotton that contains polyester fibers. The absorbent material can be made of synthetic material such as a micro fiber made from polyesters, polyamides, or a combination of polyester, polyamide and polypropylene. The absorbent material is normally made of long loops which allow for absorption of large amounts of water in which the longer the loops the more absorbent the material.

The bottom layer (32) of cloth (10) has a polygonal shape with a predetermined length and width of a conventional towel with sealed perimeter edges. As shown the cloth (10) can have a rectangular or square shape. The pre-determined length and width can vary between 6 to 12 inches or larger.

In the disclosed embodiment a top layer (25) has a polygonal shape with a predetermined length and width and is surrounded by a sealed perimeter edge defined by top edge (47), bottom edge (40), and opposing side edges (42, 44). When the sealed perimeter edge of top layer (25) is secured to the bottom layer (32) a compartment is formed there between. The compartment is divided into a soap pocket (27) and at least one elongated pocket (20) with each pocket thereon having a length that can span the length of the top layer (25) of fabric. As shown the elongated pocket has a small opening that extends linearly downward adjacent to the length of the top layer. In alternative embodiments the elongated pocket can extend the width of the top layer.

The soap pocket (27) lies adjacent to the elongated pocket (20) with the width of the soap pocket (27) being larger than the width of the elongated pocket (20). Opposing corners of top edge (47) for opposing upper triangular openings (30, 27) provides entry into soap pocket (27) and elongated pocket (30) respectively. Each upper triangular opening (30, 27) has a fastener for securing soap elements therein. In the disclosed embodiment, each fastener is Velcro, but can be other type of suitable fasteners. Soap elements can be liquid soap, a solid bar soap, or mesh container having soap therein. A mesh container dimension to be received within the soap pocket for containing the soap element in a mesh container.

Figure 2:
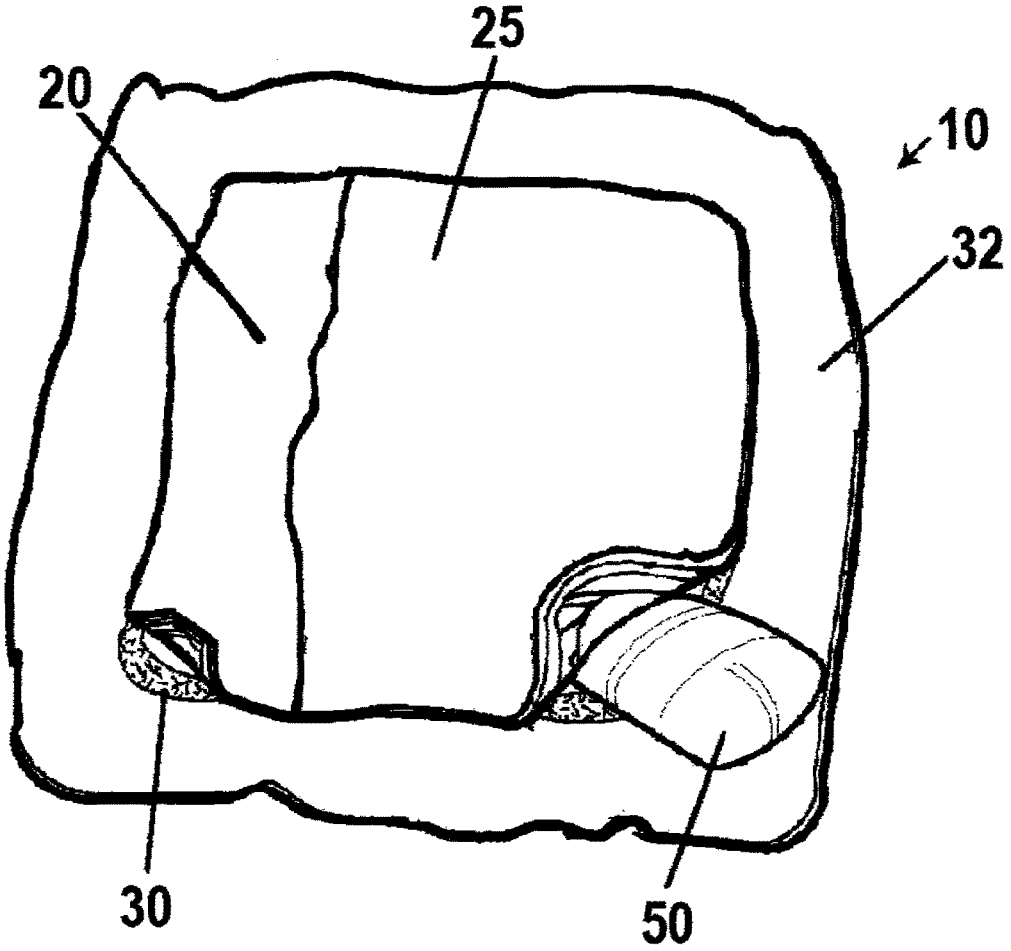
FIG. 2 depicts a perspective view of the cleaning cloth with soap being inserted in to the Velcro pocket.
Figure 2A:
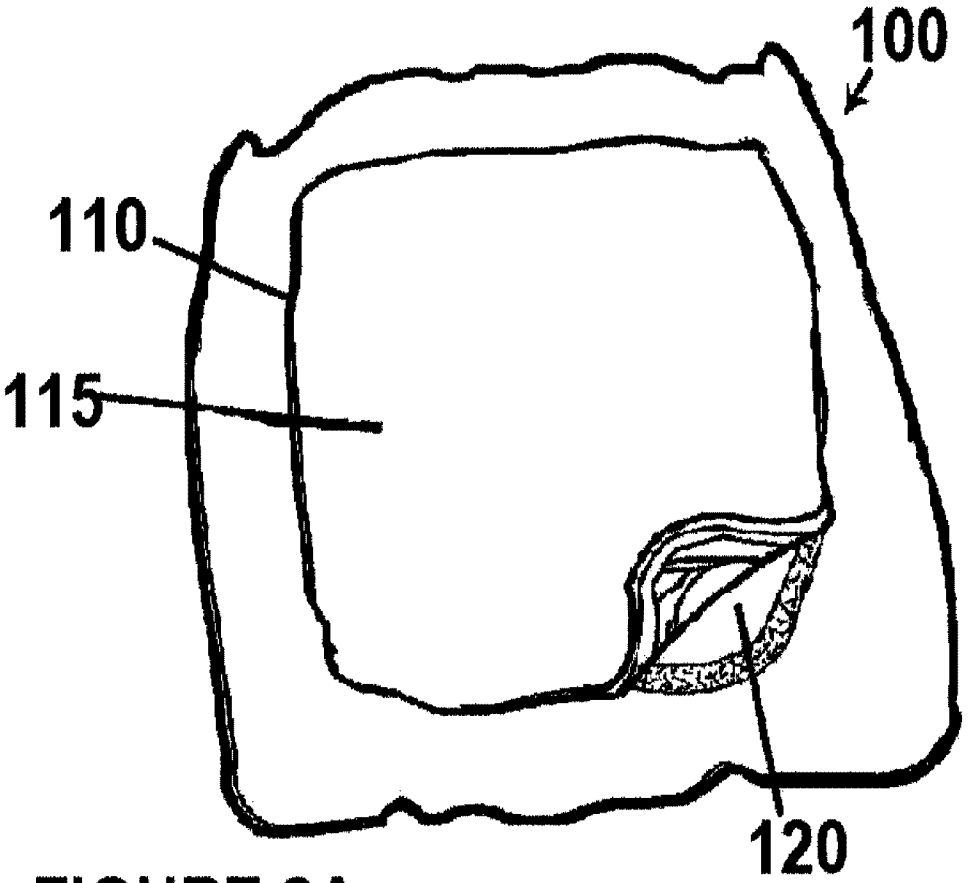
FIG. 2A depicts alternative embodiment of the present invention

In use as shown in FIGS. 2 and 2A a bar of soap (50) can be placed within the soap pocket (25) through the upper triangular opening (27). Then, liquid soap can be squirted into elongated pocket (20) through upper triangular opening (30). Once the soap elements are within the pockets, the opposing triangular openings can be secured wherein the flat surface area of cloth (10) can be moistened and placed upon the skin of a user. In alternative embodiments the liquid soap can be contained in a container that extends the length of the elongated pocket (20). The container is preferably flat and has a plurality of openings thereon allowing the soap to be contained within the elongated pocket (20).

A triangular opening in each pocket having an upper triangular opening at a corner of the soap pocket and elongated pocket for receiving therein a bar of soap element wherein the cleaning cloth lays flat upon the body. The triangular opening having a fastener for securing the soap element therein. The soap element is either liquid soap or a solid bar of soap.

Figure 3:
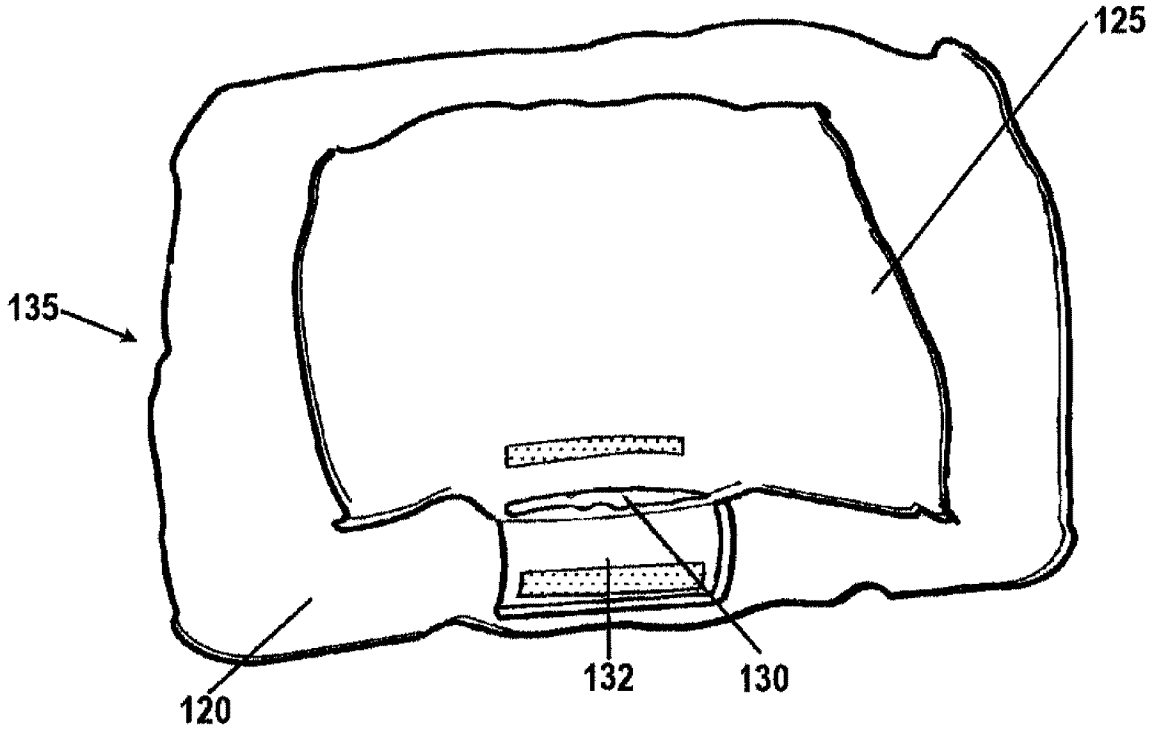
FIG. 3 depicts a perspective view of the flap to close the pocket.
Figures 4A, 4B, 4C:
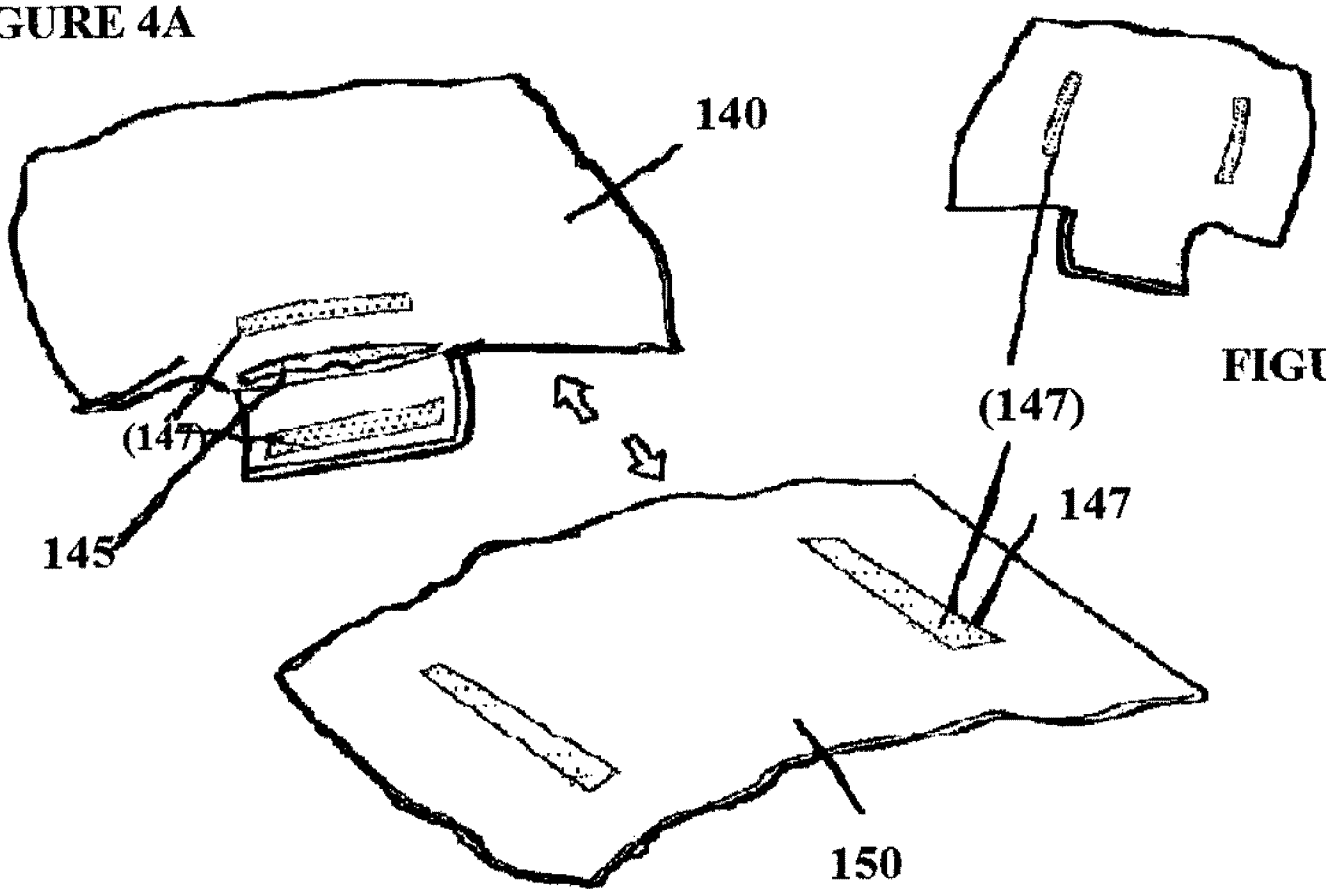
FIG. 4A depicts a perspective view of detachable pocket that Velcro to the towel.
FIG. 4B depicts a perspective view of detachable pocket that Velcro to the towel.
FIG. 4C depicts a perspective view of detachable pocket that Velcro to the towel.

At least one elongated pockets (30) can be formed on opposing sides of pocket (30) near opposing perimeter edges of cloth (10) extending substantially the pre-defined width of cloth (10). Cloth (10) can have one, two or more elongated pockets (30) spanning the surface area thereon. As shown in FIG. 3, in alternative embodiments, the fasteners can be placed horizontally across the top edge (147) of top layer (125). In yet other embodiments a flap (132) can be formed over the top edge (147). As shown in FIG. 2B, in other alternative embodiment one soap pocket can be formed upon the top layer.

Figure 5:
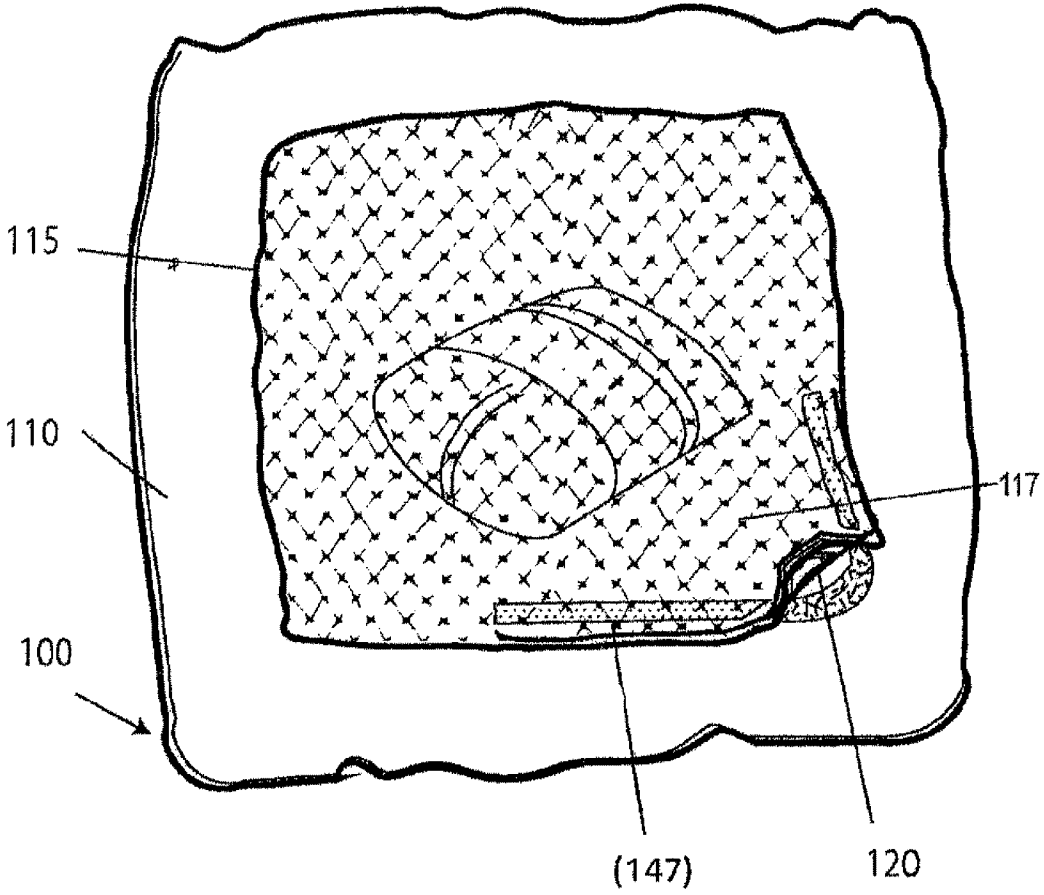
FIG. 5 depicts a perspective view of a bar of soap inside a mesh pocket.
Figures 6A, 6B, 6C:
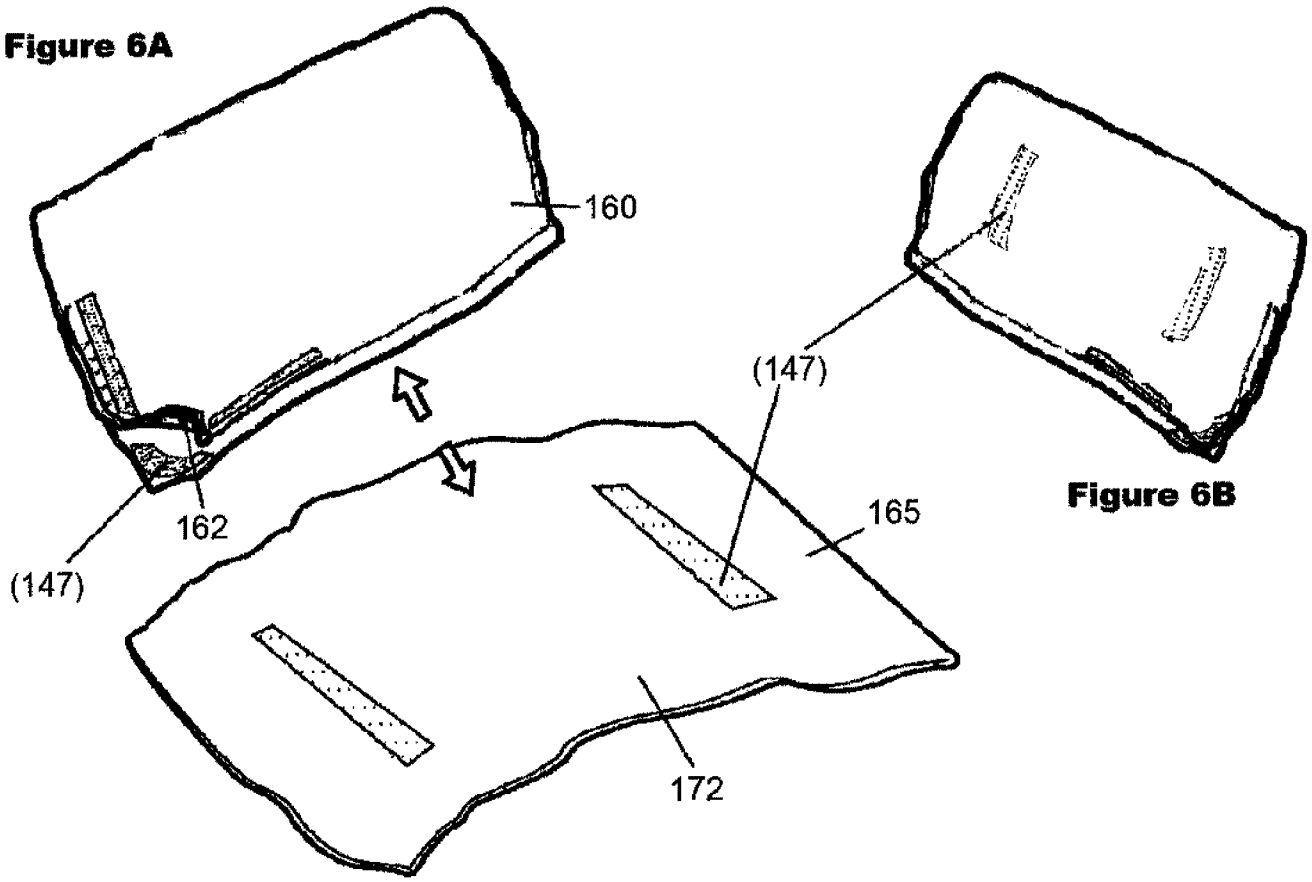
FIG. 6A depicts a perspective view of the detachable mesh pocket that Velcro to the towel.
FIG. 6B depicts a perspective view of the detachable mesh pocket that Velcro to the towel.
FIG. 6C depicts a perspective view of the detachable mesh pocket that Velcro to the towel.
Figure 7:
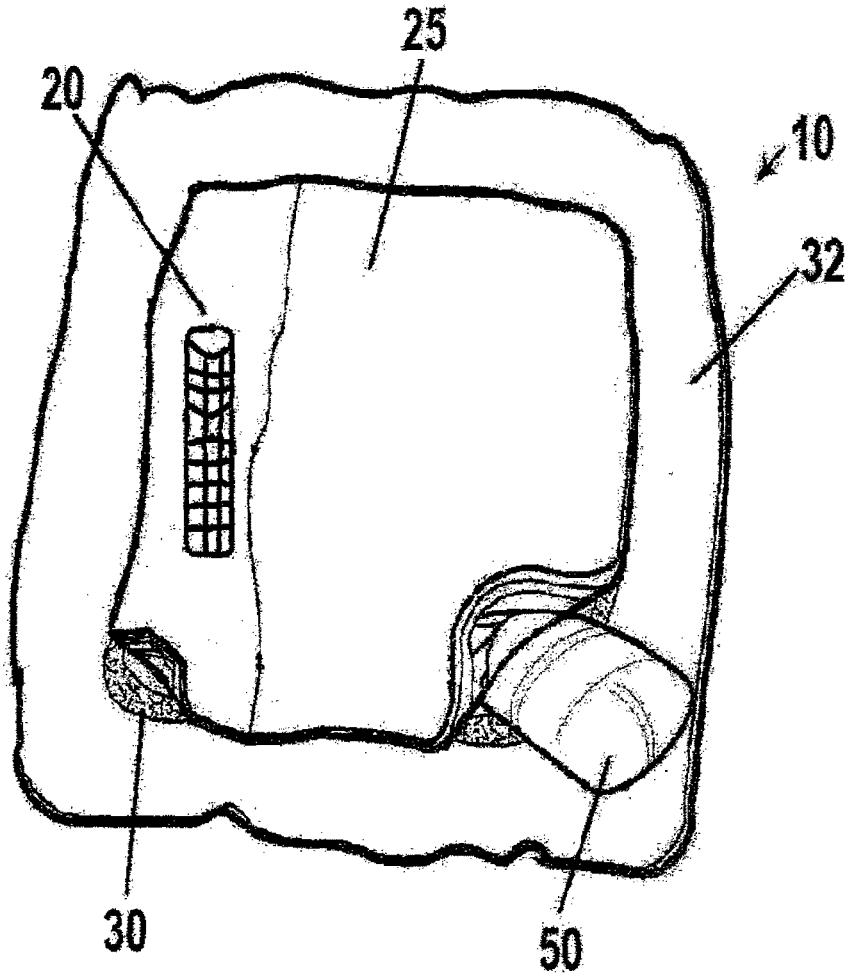
FIG. 7 depicts a perspective view of an elongated container with openings disposed within the elongated pocket.

As shown in FIGS. 6A, 6B, and 6C, in other embodiments a soap container (162) the size of a bar of soap can be formed of a dense mesh pocket filled with liquid soap. In use, a soap element would be placed within the soap container (160) and then closed as shown in FIG. 5 or removably attached to bottom layer (172) as shown in FIG. 6.

As shown in FIG. 5, in other embodiments the top layer pocket (115) can be made of a dense mesh fabric as shown in FIG. 6A-C wherein soap elements can be placed therein. In other embodiments as shown in FIG. 6A-C, top layer pocket (160) can be removable from bottom layer (170). In the illustrated embodiment complimentary male and female fasteners are used to secure the top layer pocket (160) to the upper surface of the bottom layer. As shown, a female fastener is attached to the upper surface of the bottom layer directly opposed from the male fastener attached to the underside of the top layer pocket.

What is claimed is:

1. A cleaning cloth to be used in combination with soap elements while taking a shower or bath comprising:

a top layer fabric overlying a unitary bottom layer of fabric;

the top layer fabric surrounded by an outer perimeter edge secured to the bottom layer fabric wherein a compartment is formed therebetween;

the bottom layer of fabric having a width and a length that extends beyond the top layer of fabric;

the compartment divided into a soap pocket and at least one elongated pocket the soap pocket lying adjacent to the elongated pocket;

the soap pocket having a width larger than the elongated pocket;

the soap pocket having a triangular first upper corner opening opposing a triangular second upper corner opening of the elongated pocket a parallel arrangement, the top layer of fabric having outer perimeter secured to the bottom layer of fabric except for a portion adjacent to the triangular first upper corner and the triangular second upper corner opening; and the first upper corner triangular opening and the second upper triangular corner opening having a opening for receiving a soap element where the bottom layer of fabric lies flat upon user's body while in use when wet the soap is contain within the soap pocket and disperses into the bottom layer through the top layer of fabric.

2. The cleaning cloth of claim 1 wherein triangular a securing mechanism is operationally coupled to the triangular first upper corner opening and the triangular first upper corner opening therebetween for securing the soap element therein.

3. The cleaning cloth of claim 1 wherein the soap element is a solid bar of soap.

4. The cleaning cloth of claim 1 wherein the soap element is liquid soap.

5. The cleaning cloth of claim 1 wherein the soap element is contained with a mesh container having dimensions to fit within the soap pocket.

6. The cleaning cloth of claim 1 wherein the soap element is contained within a container having dimensions to fit within the elongated pocket.

7. The cleaning cloth of claim 1 wherein the top layer fabric is made of a material from group consisting of terry cloth, polyester, polyamide and polypropylene.

8. The cleaning cloth of claim 1 wherein the bottom layer fabric is made of a material for the group consisting of terry cloth, polyester, polyamide and polypropylene.

9. A cleaning cloth comprising: a top pocket removably attached to a unitary bottom layer of fabric; the top pocket divided into a soap pocket and at least one elongated pocket; the soap pocket lying adjacent to the elongated pocket; the soap pocket having a width substantially larger than the at least one elongated pocket; the soap pocket having an outer perimeter being secured except for a portion adjacent to a corner forming a first upper corner opening opposing a second upper corner opening of the elongated pocket in a parallel arrangement;

and the first upper corner opening and the second upper corner opening having a triangular opening formed by a portion to a corner being unattached for receiving a soap element where the bottom layer of fabric lies flat upon user's body while in use.

10. The cleaning cloth of claim 9 wherein the triangular opening has a fastener attached to the triangular opening for securing the soap element therein.

11. The cleaning cloth of claim 9 wherein the soap element is a solid bar of soap.

12. The cleaning cloth of claim 9 wherein the soap element is liquid soap.

13. The cleaning cloth of claim 9 wherein the top pocket is made of a mesh fabric.

14. The cleaning cloth of claim 1 further comprising: a flat elongated container with openings thereon; and the elongated container have a length and width slightly smaller than the elongated pocket wherein the elongated container can be placed within the elongated pocket.

15. A cleaning cloth to be used in combination with soap elements while taking a shower or bath comprising:

a top layer fabric overlying a unitary bottom layer of fabric;

the top layer fabric surrounded by an outer perimeter edge secured to the bottom layer fabric wherein a compartment is formed therebetween to form a soap pocket;

the bottom layer of fabric having a width and a length that extends beyond the top layer of fabric;

the soap pocket having a triangular first upper corner opening opposing a triangular the top layer of fabric having the outer perimeter secured to the bottom layer of fabric except for a portion adjacent to a corner of the top layer fabric forming the triangular first upper corner opening; and where the bottom layer of fabric lies flat upon user's body while in use when wet the soap is contain within the soap pocket and disperses into the bottom layer through the top layer of fabric.

* * * * *